US007614102B2

(12) United States Patent
Helt, III et al.

(10) Patent No.: US 7,614,102 B2
(45) Date of Patent: Nov. 10, 2009

(54) BIOMECHANICALLY ADVANTAGEOUS PATIENT TRANSFER DEVICE

(75) Inventors: Donald G. Helt, III, Old Bridge, NJ (US); Daniel Weber, Middletown, NJ (US); Peter M. Sanzio, Lincroft, NJ (US)

(73) Assignee: LaProxima Technologies, Inc., Old Bridge, NJ (US)

( * ) Notice: Subject to any disclaimer, the term of this patent is extended or adjusted under 35 U.S.C. 154(b) by 0 days.

(21) Appl. No.: 12/132,952

(22) Filed: Jun. 4, 2008

(65) Prior Publication Data

US 2008/0295250 A1 Dec. 4, 2008

Related U.S. Application Data

(60) Provisional application No. 60/941,746, filed on Jun. 4, 2007.

(51) Int. Cl.
*A61G 1/048* (2006.01)

(52) U.S. Cl. ..... 5/625; 5/628; 128/870

(58) Field of Classification Search ..... 5/625–630, 5/81.1 HS; 128/870
See application file for complete search history.

(56) References Cited

U.S. PATENT DOCUMENTS 3,663,972 A * 5/1972 Denton ..... 5/625
4,183,110 A 1/1980 Kidd et al.
4,584,729 A * 4/1986 Roberts et al. ..... 5/625
5,473,784 A 12/1995 Nixon et al.
5,771,513 A * 6/1998 Kirchgeorg et al. ..... 5/625
5,950,627 A * 9/1999 Bologovsky et al. ..... 128/869
6,061,853 A 5/2000 Laaksonen et al.
6,073,287 A * 6/2000 Svensson ..... 5/625
6,715,170 B2 * 4/2004 Richmond ..... 5/625
7,303,705 B2 12/2007 Panton
7,337,484 B2 * 3/2008 Cox ..... 5/625
2006/0282946 A1 * 12/2006 Meyer ..... 5/81.1 HS
2007/0277318 A1 12/2007 Rak

OTHER PUBLICATIONS

RescuePad, Product Brochure, Downloaded from the Internet, http://www.rapiddeploymentproducts.com/images/rescuepad.pdf, 2007, Rapid Development Products, Inc., Copy consists of 2 pages, USA.

Dyna Med Multipurpose Spine Board, Product Web Page, Downloaded from the Internet, http://www.galls.com/style.html?assort=fireauthority&style=SB026&cat=4501, 2008, Galls—An Aramark Company, Copy consists of 1 page, USA.

BaXstrap Spineboard, Product web page, Downloaded for the Internet, http://www.laerdal.info/document.asp?subnodeid=6256638, 2007, Laerdal Medical, Copy consists of 1 page, USA.

(Continued)

*Primary Examiner*—Michael Trettel
(74) *Attorney, Agent, or Firm*—Wall & Tong, LLP

(57) ABSTRACT

In one embodiment, the present invention is a biomechanically advantageous patient transfer device. One embodiment of a patient transfer device includes a body configured for supporting a patient thereon, a plurality of flanges coupled to the body and extending outward therefrom, and a plurality of handles configured for allowing the patient transfer device to be lifted, at least one handle being formed in each flange.

20 Claims, 4 Drawing Sheets

OTHER PUBLICATIONS

Bariatric Transfer-Flat, Product web page, Downloaded from the Internet, http://www.ems.stryker.com/transferflat.jsp, 2008, Styker EMS, Copy consists of 1 page, USA.

MRI Transfer Board, p. 65 of product catalog, http://www.technoaide.com/p/fullpage.php?page=065&session=1117845, 2008, Techno-Aide, Copy consists of 1 page, USA.

PerfectView Deluxe Transfer Board, Product web page, Downloaded from the Internet, http://www.cpacequipment.com/pvaccessories.asp, 2008, CPAC Equipment, Inc., Copy consists of 1 page, USA.

Bak-Pak Spine Boards, Product Brochure, Downloaded from the Internet, http://www.epandr.com/downloads/images/SpineBoards.pdf, 2006, Emergency Products + Research, Inc., Cop consists of 9 pages, USA.

* cited by examiner

BIOMECHANICALLY ADVANTAGEOUS PATIENT TRANSFER DEVICE

CROSS REFERENCE TO RELATED APPLICATIONS

This application claims the benefit of U.S. Patent Application No. 60/941,746, filed Jun. 4, 2007, which is herein incorporated by reference in its entirety.

FIELD OF THE INVENTION

The invention relates generally to healthcare and emergency services and relates more particularly to patient transfer devices.

BACKGROUND OF THE DISCLOSURE

A spine board, or backboard, is a medical device used for the immobilization and transportation of patients with suspected spinal injuries. FIGS. 1A and 1B are side and top views, respectively, illustrating the use of a typical spine board 100 to transport a patient. As illustrated, the patient lies on the spine board, which is usually carried by at least two lifters (one on either side of the patient).

Typical spine boards such as the one illustrated tend to be very narrow (e.g., approximately sixteen inches wide). This requires the lifters to flex their trunks and their arms away from their centers of gravity (as illustrated), which increases the biomechanical forces acting on their spines and shoulders.

These forces may be exacerbated when the patient is to be lifted from a low resting surface such as the floor, a bed, or a table (such as table 102 in FIGS. 1A and 1B), or when the patient is especially large. The greater the biomechanical forces acting on the spines and shoulders of the lifters, the greater the risk that the lifters will injure themselves.

Thus, there is a need in the art for a method and apparatus for biomechanically advantageous patient transfer device.

SUMMARY OF THE INVENTION

In one embodiment, the present invention is a biomechanically advantageous patient transfer device. One embodiment of a patient transfer device includes a body configured for supporting a patient thereon, a plurality of flanges coupled to the body and extending outward therefrom, and a plurality of handles configured for allowing the patient transfer device to be lifted, at least one handle being formed in each flange.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

In one embodiment, the present invention is a biomechanically advantageous patient transfer device, such as a spine board or backboard. Embodiments of the patient transfer device employ inventive user lifting mechanics that allow a lifter to transfer a patient from floor-to-standing or from bed-to-standing heights with minimal musculoskeletal risk to the lower back of the lifter. Specifically, the patient transfer device forces the load carried (i.e., the patient) to be applied closer to the lifter's center of gravity, thereby drastically lowering the compressive forces and torque about the L5/S1 region of the spine. The form of the patient transfer device can support larger-sized patients and provides a more stable lifting experience for both the patient and the lifters.

Figure 1B:
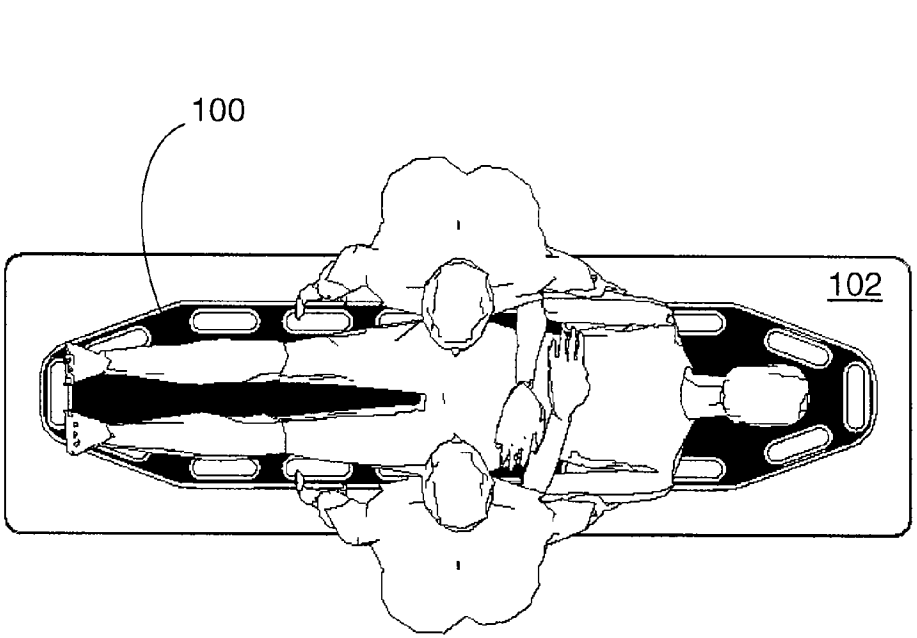
Fig. 1B (Prior Art)
FIGS. 1A and 1B are side and top views, respectively, illustrating the use of a typical spine board to transport a patient.
Figure 1A:
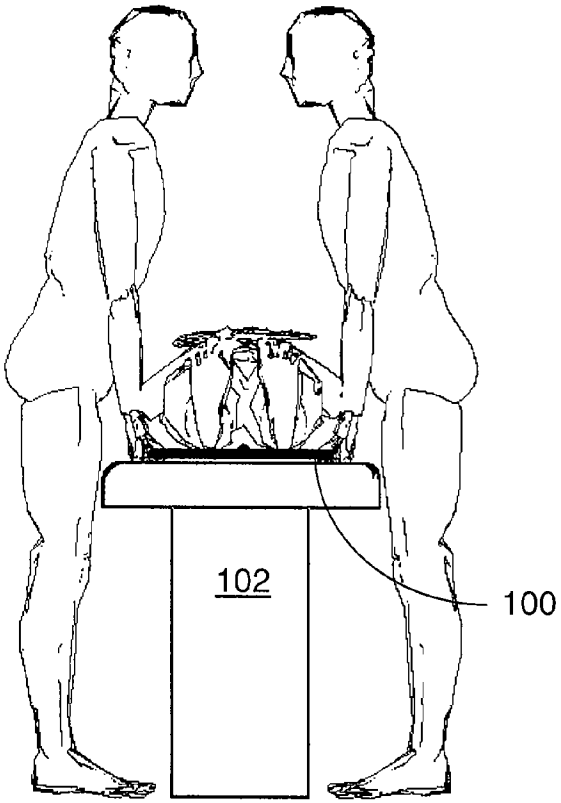
Fig. 1A (Prior Art)
Figure 2:
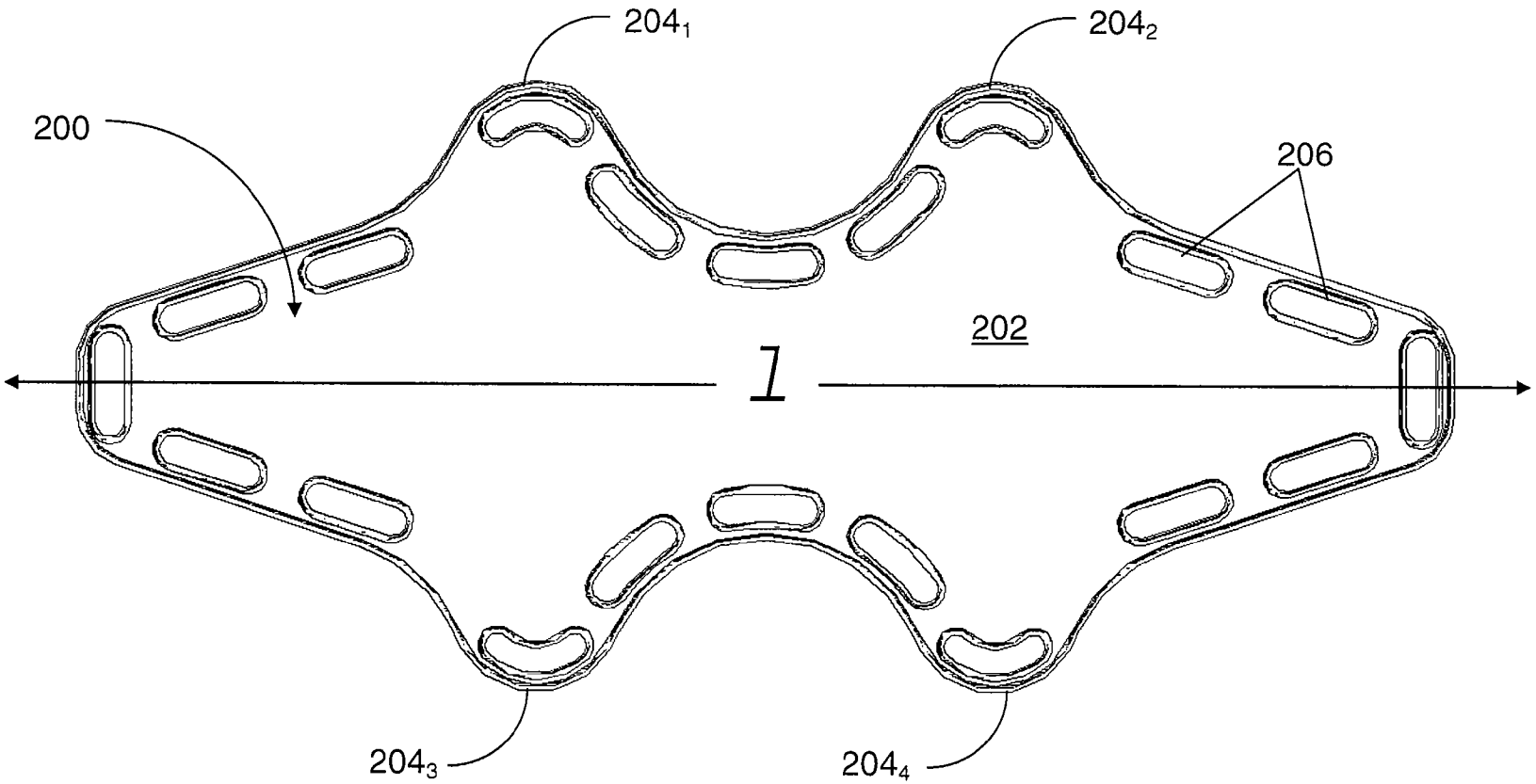
FIG. 2 is a top view illustrating a first embodiment of a patient transfer device, according to the present invention.

FIG. 2 is a top view illustrating a first embodiment of a patient transfer device 200, according to the present invention. The patient transfer device 200 may be used, for example, to safely move a human patient from a floor or a bed to another location. As illustrated, the device 200 comprises a substantially flat or slightly contoured (e.g., to accommodate and support the human form), substantially rigid body 202. The body 202 is substantially symmetrical about a longitudinal axis I and is sized and shaped to accommodate a human patient lying thereon. In one embodiment, the body 202 is formed from at least one of wood or plastic, the wood or plastic being in a solid or semi-solid (e.g., foam-filled) state. In one embodiment, the body 202 includes internal lateral ribbing or reinforcement (e.g., in the form of carbon rods).

A plurality of flanges $\mathbf{204}_1$-$\mathbf{204}_4$ (hereinafter collectively referred to as "flanges 204") extend outward from the body 202, away from the longitudinal axis I. In other embodiments, the flanges 204 may extend away from a lateral axis of the body (not shown). In the embodiment illustrated, the device 200 includes four flanges 204: two flanges 204 extending from a first side of the body 202 and two flanges 204 extending from an opposite second side of the body 202. In one embodiment, the flanges 204 are formed integrally with the body 202 and have a substantially rounded or curved shape.

A plurality of handles 206 are disposed around the perimeter of the body 202 and the flanges 204. In one embodiment, the handles 206 comprise apertures that are sized and shaped to be gripped by a human hand. In one embodiment, the handles 206 are positioned to accommodate what is known in the art as a neutral body posture of a lifter (i.e., a relaxed standing posture in which the hands are typically an estimable distance apart). In one embodiment, each of the flanges 204 includes at least one handle 206. Thus, the flanges 204 are adapted to be gripped by a lifter. Handles 206 in addition to those formed in the flanges 204 allow for assistance from additional lifters.

Figure 3B:
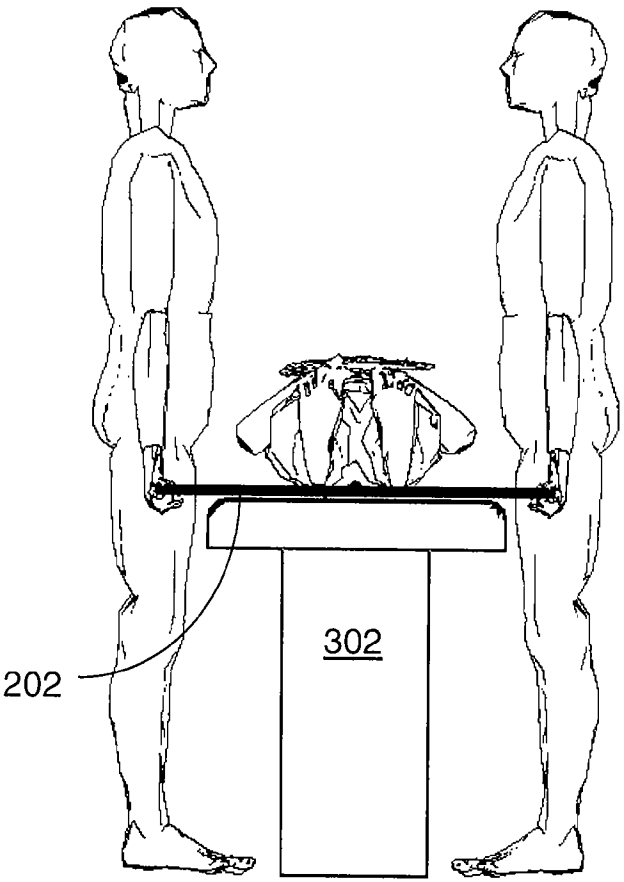
FIGS. 3A and 3B are side and top views, respectively, illustrating the use of the patient transfer device illustrated in FIG. 2 to transport a patient.
Figure 3A:
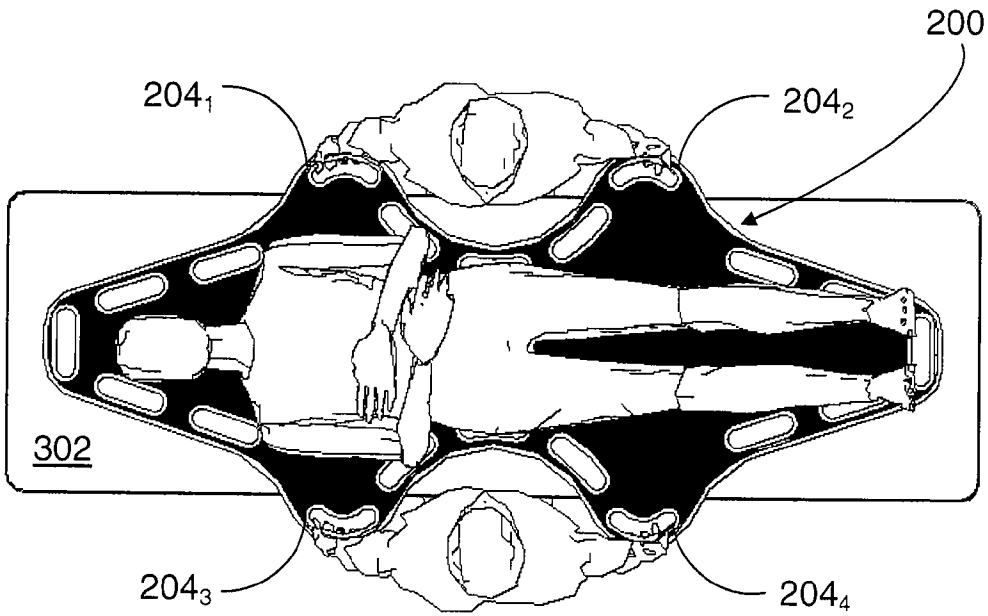

FIGS. 3A and 3B are side and top views, respectively, illustrating the use of the patient transfer device 200 illustrated in FIG. 2 to transport a patient. As illustrated, by gripping the flanges 204, the lifters are able to maintain a more vertical lifting position, with minimal flexion of the spine or arms. The resultant forces act axially on the spine, limiting the moment, shearing, and compressive forces acting thereon. This provides a more controlled lifting experience for both the lifter and the patient. Moreover, as illustrated, the resting surface 302 does not interfere with the lifters' mechanics when the patient transfer device 200 is used.

Moreover, the wider-than-typical width profile of the patient transfer device 200 better supports larger than average (including overweight) patients, while the placement of the handles 206 around the perimeter makes such tasks more comfortable for the lifters.

Figure 4:
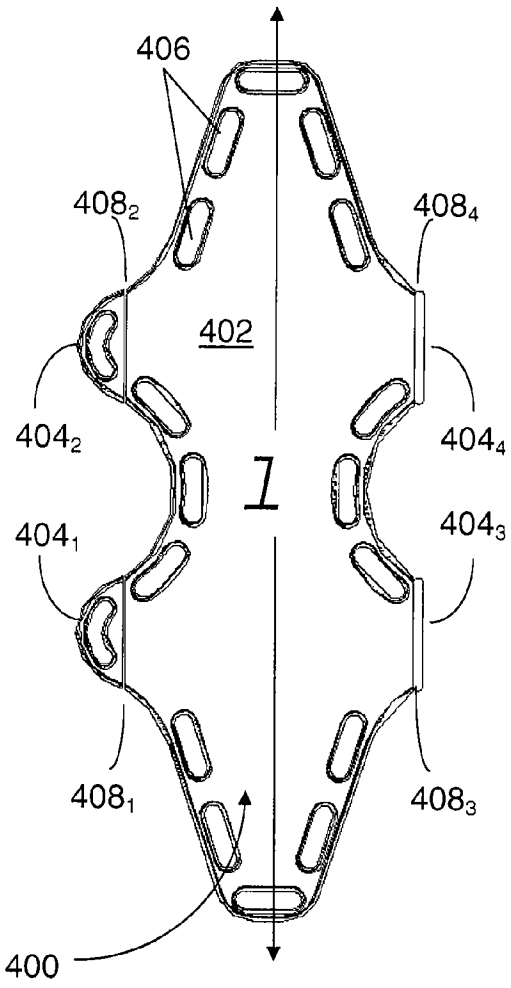
FIG. 4 is a top view illustrating a second embodiment of a patient transfer device, according to the present invention.

FIG. 4 is a top view illustrating a second embodiment of a patient transfer device 400, according to the present invention. The patient transfer device 400 may be used, for example, to safely move a human patient from a floor or a bed to another location. As illustrated, the device 400 comprises a substantially flat or slightly contoured (e.g., to accommodate and support the human form), substantially rigid body 402. The body 402 is substantially symmetrical about a longitudinal axis I and is sized and shaped to accommodate a human patient lying thereon. In one embodiment, the body 402 is formed from at least one of wood or plastic, the wood or plastic being in a solid or semi-solid (e.g., foam-filled) state. In one embodiment, the body 402 includes internal lateral ribbing or reinforcement (e.g., in the form of carbon rods).

A plurality of flanges $\mathbf{404}_1$-$\mathbf{404}_4$ (hereinafter collectively referred to as "flanges 404") extend outward from the body 402, away from the longitudinal axis I. In the embodiment illustrated, the device 400 includes four flanges 404: two flanges 404 extending from a first side of the body 402 and two flanges 404 extending from an opposite second side of the body 402. The flanges 404 are shaped and sized similarly to the flanges 204 of the patient transfer device 200 illustrated in FIG. 2, except that the flanges 404 are hinged rather than formed integrally with the body 402. Specifically, the flanges 404 are rotatable about respective hinges $\mathbf{408}_1$-$\mathbf{408}_4$ (hereinafter referred to as "hinges 408").

A plurality of handles 406 are disposed around the perimeter of the body 402 and the flanges 404. In one embodiment, the handles 406 comprise apertures that are sized and shaped to be gripped by a human hand. In one embodiment, the handles 406 are positioned to accommodate a neutral body posture of a lifter. In one embodiment, each of the flanges 404 includes at least one handle 406. Thus, the flanges 404 are adapted to be gripped by a lifter. Handles 406 in addition to those formed in the flanges 404 allow for assistance from additional lifters.

Like the patient transfer device 200 illustrated in FIG. 2, the patient transfer device 400 allows the lifters to maintain a more vertical lifting position, with minimal flexion of the spine or arms. Moreover, the hinges 408 allow the flanges 404 to be rotated upward or downward (e.g., as illustrated by the flanges $\mathbf{404}_3$ and $\mathbf{404}_4$ in FIG. 4) to permit passage through narrow spaces or placement on narrow resting surfaces with minimal interference. In additional, rotating the flanges 404 upward may prevent unwanted patient movement by providing lateral stops.

Moreover, the wider-than-typical width profile of the patient transfer device 400 better supports larger than average (including overweight) patients, while the placement of the handles 406 around the perimeter makes such tasks more comfortable for the lifters.

Figure 5B:
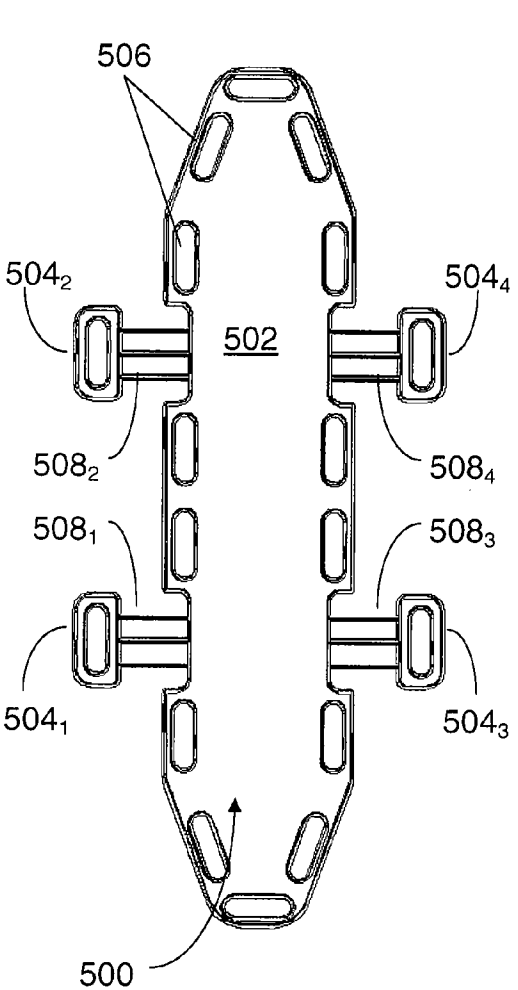
FIGS. 5A-5B are a top views illustrating a second embodiment of a patient transfer device, according to the present invention.
Figure 5A:
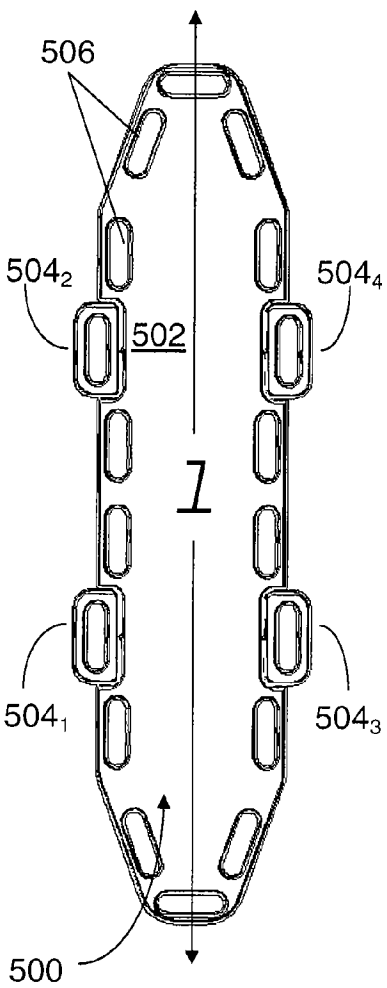

FIGS. 5A-5B are a top views illustrating a second embodiment of a patient transfer device 500, according to the present invention. The patient transfer device 500 may be used, for example, to safely move a human patient from a floor or a bed to another location. As illustrated, the device 500 comprises a substantially flat or slightly contoured (e.g., to accommodate and support the human form), substantially rigid body 502. The body 502 is substantially symmetrical about a longitudinal axis I and is sized and shaped to accommodate a human patient lying thereon. In one embodiment, the body 502 is formed from at least one of wood or plastic, the wood or plastic being in a solid or semi-solid (e.g., foam-filled) state. In one embodiment, the body 502 includes internal lateral ribbing or reinforcement (e.g., in the form of carbon rods).

A plurality of flanges $\mathbf{504}_1$-$\mathbf{504}_4$ (hereinafter collectively referred to as "flanges 504") extend outward from the body 502, away from the longitudinal axis I. In the embodiment illustrated, the device 500 includes four flanges 504: two flanges 504 extending from a first side of the body 502 and two flanges 504 extending from an opposite second side of the body 502. The flanges 504 comprise telescoping handles. Specifically, the flanges 504 are coupled to respective laterally telescoping extensions $\mathbf{508}_1$-$\mathbf{508}_4$ (hereinafter referred to as "extensions 508"; illustrated in FIG. 5B) that allow the flanges 504 to be pulled outward and away from the body 502 (as illustrated in FIG. 5B) or to be collapsed back into the body 502 (as illustrated in FIG. 5A). Thus, although the patient transfer device 500 has a width profile substantially similar to that of a traditional spine board when the flanges 504 are collapsed, extension of the flanges 504 allows for improved stability and control in use.

A plurality of handles 506 are disposed around the perimeter of the body 502 and the flanges 504. In one embodiment, the handles 506 comprise apertures that are sized and shaped to be gripped by a human hand. In one embodiment, the handles 506 are positioned to accommodate a neutral body posture of a lifter. In one embodiment, each of the flanges 504 includes at least one handle 506. Thus, the flanges 504 are adapted to be gripped by a lifter. Handles 506 in addition to those formed in the flanges 504 allow for assistance from additional lifters.

Like the patient transfer devices 200 and 400 illustrated in FIGS. 2 and 4, the patient transfer device 500 allows the lifters to maintain a more vertical lifting position, with minimal flexion of the spine or arms. Moreover, the telescoping flanges 504 are more accommodating to varied lifting surface widths and patient sizes.

The inventive lifting mechanics employed by the patient transfer device of the present invention therefore allow a lifter to transfer a patient from floor-to-standing or from bed-to-standing heights with minimal musculoskeletal risk to the lower back of the lifter. By forcing the load carried (i.e., the patient and spine board) to be applied closer to the lifter's center of gravity, the compressive forces and torque about the L5/S1 region of the spine are drastically lowered. The patient transfer device may therefore be advantageously put into use in a variety of institutions, including, but not limited to, hospitals, long term care facilities, outpatient care facilities, firehouses, emergency service units, academic institutions, athletic institutions, and health clubs.

While the foregoing is directed to the preferred embodiment of the present invention, other and further embodiments of the invention may be devised without departing from the basic scope thereof.

What is claimed is:

1. A patient transfer device, comprising:

a body configured for supporting a patient thereon and formed of a first material;

a plurality of flanges coupled to the body and projecting substantially outward therefrom, wherein the plurality of flanges is formed integrally with the body; and a plurality of handles configured for allowing the patient transfer device to be lifted, at least one of the plurality of handles being formed in each of the plurality of flanges, wherein the plurality of flanges is shaped and positioned such that when the patient transfer device is under load, a majority of forces resulting from the load act axially on a spine of an individual who is positioned between two of the plurality of flanges and is lifting the patient transfer device.

2. The patient transfer device of claim 1, wherein each of the plurality of flanges has a substantially rounded shape.

3. The patient transfer device of claim 1, wherein the plurality of handles is formed around a perimeter of the body.

4. The patient transfer device of claim 1, wherein the plurality of handles comprises apertures formed in the body, the apertures being sized and shaped to be gripped by a human hand.

5. The patient transfer device of claim 1, wherein the plurality of handles is positioned to support a neutral body posture of a lifter.

6. The patient transfer device of claim 1, wherein the body is sized and shaped to support a human patient.

7. The patient transfer device of claim 1, wherein the body is substantially flat or slightly contoured to accommodate and support a human form.

8. The patient transfer device of claim 1, wherein the body comprises internal lateral ribbing formed of a second material different from the first material.

9. The patient transfer device of claim 1, wherein the body is substantially rigid.

10. The patient transfer device of claim 9, wherein the body is formed of solid or semi-solid wood or plastic.

11. A patient transfer device, comprising:

a body configured for supporting a patient thereon;

a plurality of flanges coupled to the body by a plurality of hinges and projecting substantially outward therefrom; and a plurality of handles configured for allowing the patient transfer device to be lifted, at least one of the plurality of handles being formed in each of the plurality of flanges, wherein the plurality of flanges is shaped and positioned such that when the patient transfer device is under load, a majority of forces resulting from the load act axially on a spine of an individual who is positioned between two of the plurality of flanges and is lifting the patient transfer device.

12. The patient transfer device of claim 1, wherein the plurality of flanges comprises four flanges, two flanges disposed along a first side of the body and two flanges disposed along an opposite second side of the body.

13. The patient transfer device of claim 11, wherein the body is sized and shaped to support a human patient.

14. The patient transfer device of claim 11, wherein the body is substantially flat or slightly contoured to accommodate and support a human form.

15. The patient transfer device of claim 11, wherein the body is formed of a first material and comprises internal lateral ribbing formed of a second material different from the first material.

16. The patient transfer device of claim 11, wherein the body is substantially rigid.

17. The patient transfer device of claim 16, wherein the body is formed of solid or semi-solid wood or plastic.

18. The patient transfer device of claim 11, wherein the plurality of flanges comprises four flanges, two flanges disposed along a first side of the body and two flanges disposed along an opposite second side of the body.

19. The patient transfer device of claim 11, wherein the plurality of handles is formed around a perimeter of the body.

20. The patient transfer device of claim 11, wherein the plurality of handles is positioned to support a neutral body posture of a lifter.

* * * * *